US011779138B2

(12) United States Patent
Danzinger et al.

(10) Patent No.: US 11,779,138 B2
(45) Date of Patent: Oct. 10, 2023

(54) POP-OPEN GROUND COVER WITH DETACHABLE SUPPORT SYSTEM

(71) Applicant: Brodan LLC, Surfside, FL (US)

(72) Inventors: Shlomo Danzinger, Surfside, FL (US); Levi Danzinger, Miami, FL (US)

(73) Assignee: Brodan LLC, Surside, FL (US)

( * ) Notice: Subject to any disclaimer, the term of this patent is extended or adjusted under 35 U.S.C. 154(b) by 109 days.

(21) Appl. No.: 17/497,971

(22) Filed: Oct. 10, 2021

(65) Prior Publication Data

US 2022/0160149 A1 May 26, 2022

Related U.S. Application Data

(60) Provisional application No. 63/117,999, filed on Nov. 24, 2020.

(51) Int. Cl.
*A47G 9/06* (2006.01)

(52) U.S. Cl.
CPC ..... *A47G 9/062* (2013.01)

(58) Field of Classification Search
CPC . A47G 9/062; A47G 9/06; A47G 9/08; A47G 9/083; A47G 9/086; A63B 21/4037; A61G 7/1023; E04H 15/006
See application file for complete search history.

(56) References Cited

U.S. PATENT DOCUMENTS 2,264,471 A * 12/1941 Glenn ..... A47G 9/062 5/419
2,442,105 A 5/1948 Vacheron
2,870,464 A 1/1959 Lalick
4,634,618 A 1/1987 Greer et al.
4,709,430 A 12/1987 Nicoll
4,951,333 A * 8/1990 Kaiser ..... A47G 9/062 135/126
4,999,866 A 3/1991 Lindsey
5,018,230 A * 5/1991 Steberger ..... A47K 10/02 428/109
5,024,262 A 6/1991 Huang
5,056,172 A 10/1991 Kaiser et al.
5,059,463 A 10/1991 Peters
5,299,331 A 4/1994 Badillo
5,435,024 A * 7/1995 Capshaw ..... A47G 9/062 135/141

(Continued)

*Primary Examiner* — Justin C Mikowski
*Assistant Examiner* — Amanda L Bailey
(74) *Attorney, Agent, or Firm* — LaMorte & Associates, P.C.

(57) ABSTRACT

A folding ground cover assembly that can automatically pop open when released. The ground cover assembly has a fabric panel that is selectively supported by a detachable support mesh. The support mesh has a peripheral band that surrounds an open central area. Various cross straps extend across the open central area between points along the peripheral band. A spring wire engages the peripheral band of the support mesh and biases the peripheral band into an open, flat configuration. A first plurality of fasteners is disposed on the support mesh that engages a second plurality of fasteners on the underside of the fabric panel. The fasteners are used to connect the fabric panel to the support mesh, wherein the fabric panel covers the open central area and the fabric panel is supported by the cross straps.

13 Claims, 4 Drawing Sheets

(56) References Cited

U.S. PATENT DOCUMENTS

| | | | | |
|---|---|---|---|---|
| 5,573,156 | A * | 11/1996 | McConnell | A47D 13/02 D3/214 |
| 6,170,100 | B1 * | 1/2001 | Le Gette | A47G 9/062 297/229 |
| 6,343,391 | B1 | 2/2002 | Le Gette et al. | |
| 7,398,612 | B2 * | 7/2008 | Zheng | A63H 33/008 160/354 |
| 7,661,160 | B1 | 2/2010 | Adams | |
| 9,259,108 | B2 | 2/2016 | Snep | |
| 9,776,033 | B2 * | 10/2017 | Fasullo | A63B 21/4037 |
| 2002/0157183 | A1 * | 10/2002 | Zheng | A47G 9/062 5/420 |
| 2014/0000984 | A1 * | 1/2014 | Thornton | A63B 21/4037 185/37 |
| 2019/0335866 | A1 * | 11/2019 | Schwartz | A45C 13/36 |

* cited by examiner

POP-OPEN GROUND COVER WITH DETACHABLE SUPPORT SYSTEM

RELATED APPLICATIONS

This application claims the priority of U.S. Provisional application No. 63/117,999 filed Nov. 24, 2020.

BACKGROUND OF THE INVENTION

1. Field of the Invention

In general, the present invention relates to supports that are intended to hold open fabric ground covers, such as towels, beach blankets, picnic blankets and the like. More particularly, the present invention relates to supports that utilize spring wire to maintain the peripheral shape of a ground cover.

2. Prior Art Description

People often have a ground cover if they intend to sit on the ground. For example, people traveling to a beach typically bring a beach blanket or towel to sit or lay upon. This makes sitting on the beach more comfortable and prevents beach sand from sticking to the person's cloths and body. Likewise, a person on a picnic may choose to sit on a ground cover to prevent grass stains. The ground covers used for such purposes are typically made of fabric and come in the form of a blanket or a towel.

A problem with such fabric ground covers is that they do not remain fully open once used. As a person sits or stands on a ground cover, the ground cover deforms and contracts toward the deformation. This reduces the area on the ground that is protected by the ground cover. After repeated deformations, the area protected by the ground cover can be so diminished that the ground cover must be lifted up and deployed anew.

In the prior art, there are many specialized ground covers that are designed to maintain their maximum coverage area, despite being stood or sat upon. Some prior art systems add weight to the periphery of the blanket or towel. Such prior art is exemplified by U.S. Pat. No. 4,999,866 to Lindsey and U.S. Pat. No. 4,709,430 to Nicoll. The added weight reduces the degree to which the blanket or towel contracts when sat or stood upon. However, contraction still occurs. Furthermore, since the weights are integrated into the periphery of the towel or blanket, it is difficult to utilize the towel or blanket for another purpose, such as drying a swimmer or keeping warm.

Another approach applied to ground covers is to provide the ground cover with a rigid peripheral frame. The frame maintains the shape of the open towel or blanket and prevents any deformations from occurring. The peripheral frames can be made from assembled frame sections, as disclosed in U.S. Pat. No. 7,661,160 to Adams, or made from spring wire frames as disclosed in U.S. Pat. No. 6,343,391 to LeGette or U.S. Pat. No. 5,056,172 to Kaiser. Although wire frames can flex, the use of a wire frame prevents a towel or blanket from being wrapped around a user's body. Furthermore, in order to launder the towel or blanket, the spring wire must be removed. Stringing a spring wire through the periphery of a towel or blanket can be a very tedious chore. This detracts from the commercial appeal of ground covers with spring wire frames.

A need therefore exists for an improved system for holding a ground cover open, wherein a peripheral frame is used to hold the ground cover open, yet the frame does not prevent the ground cover from being wrapped around a person or easily laundered.

SUMMARY OF THE INVENTION

The present invention is a folding ground cover assembly that can automatically pop open when released. The ground cover assembly has a fabric panel that is selectively supported by a detachable support mesh. The support mesh has a peripheral band that surrounds an open central area. Various cross straps extend across the open central area between points along the peripheral band.

A spring wire engages the peripheral band of the support mesh and biases the peripheral band into an open, flat configuration. A first plurality of fasteners is disposed on the support mesh that engages a second plurality of fasteners on the underside of the fabric panel. The fasteners are used to connect the fabric panel to the support mesh, wherein the fabric panel covers the open central area and the fabric panel is supported by the cross straps.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention assembly can be embodied in many ways, only one exemplary embodiment is illustrated. The exemplary embodiment is being shown for the purposes of explanation and description. The exemplary embodiment is selected in order to set forth one of the best modes contemplated for the invention. The illustrated embodiment, however, is merely exemplary and should not be considered a limitation when interpreting the scope of the claims.

Figure 1:
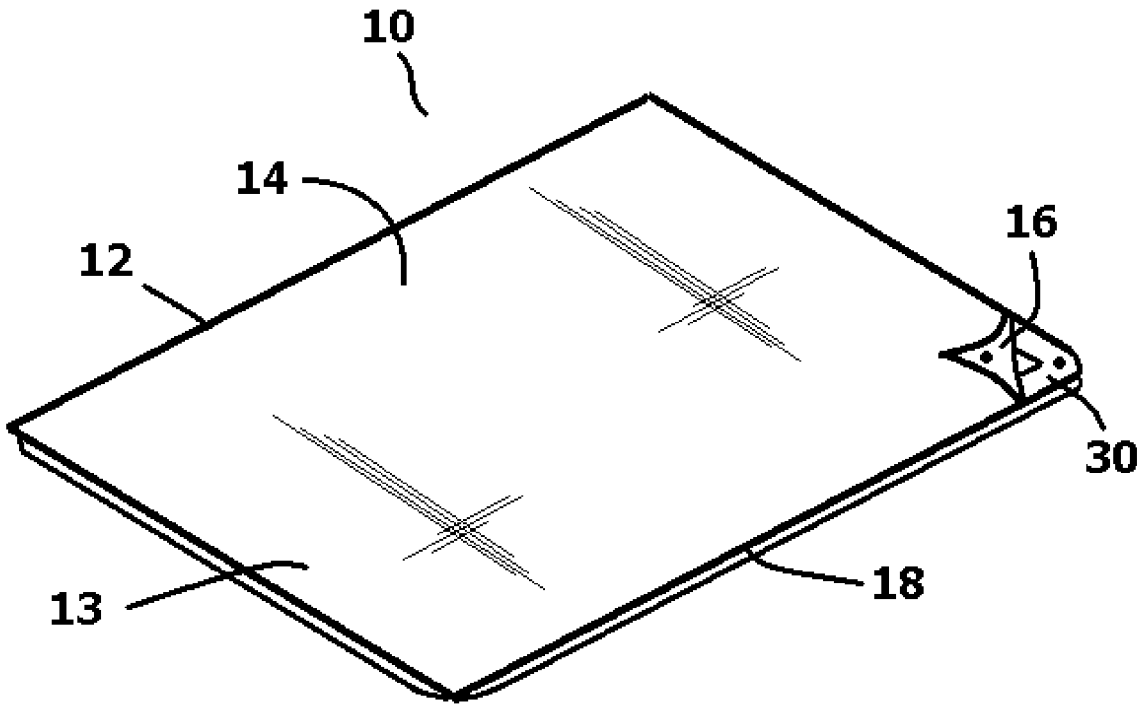
FIG. 1 shows an exemplary embodiment of the present invention ground cover assembly.
Figure 2:
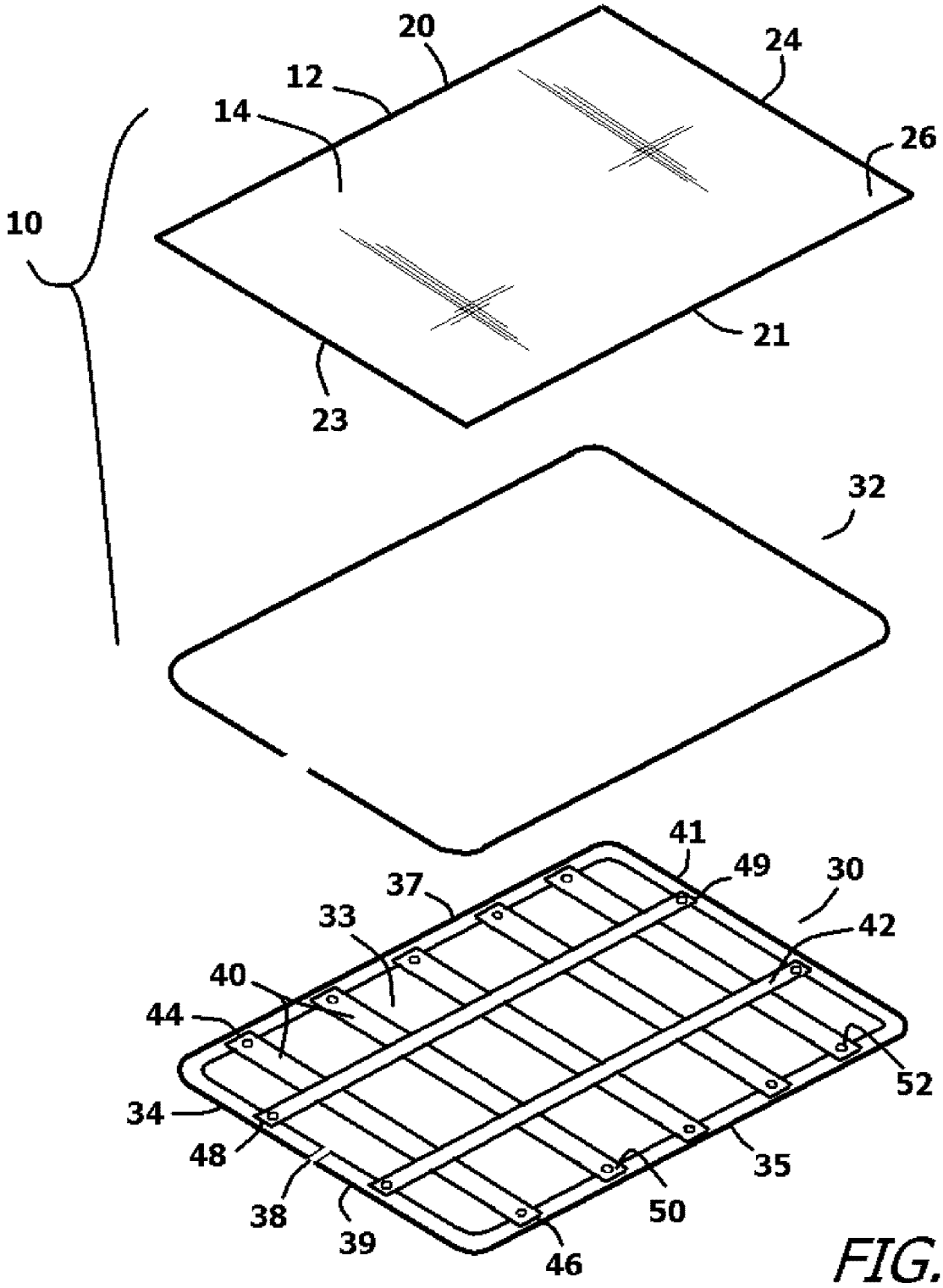
FIG. 2 is an exploded view of the exemplary embodiment of FIG. 1.

Referring to FIG. 1 and FIG. 2, a ground cover assembly 10 is shown. The ground cover assembly 10 includes a fabric panel 12. By way of example, in the shown embodiment the fabric panel 12 is configured as a beach towel 13. However, other fabric panels, such as beach blankets, picnic blankets, sunshades, drop cloths and the like, can be substituted. The fabric panel 12 has a top first surface 14 and a bottom second surface 16. In use, the top first surface 14 contacts the person sitting or standing on the ground cover assembly 10 and the bottom second surface 16 faces the ground. The top first surface 14 and the bottom second surface 16 have a shared peripheral edge 18 that is generally rectangular in shape. That is, the fabric panel 12 has four sides that include two parallel long sides 20, 21 and two parallel short sides 23, 24. The corners 26 of adjacent sides can be right angles or rounded.

The fabric panel 12 contains a plurality of detachable fasteners 28 on its bottom second surface 16. The detachable fasteners 28 are used to selectively connect the fabric panel 12 to an underlying support mesh 30. Once connected, the fabric panel 12 is selectively held taut in an open planar configuration by the support mesh 30. The support mesh 30 is preferably made from synthetic material, such as polyester or polycaprolactam, hydrophobic. In this manner, the support mesh 30 will not absorb any water that it contacts. The support mesh 30 will, therefore, not transfer moisture to the fabric panel 12 when in contact with the fabric panel 12.

The support mesh 30 is biased into a flat open configuration by a shaped spring wire 32. The shaped spring wire 32 has a form that spreads larger than the periphery of the support mesh 30. The support mesh 30 receives and retains the shaped spring wire 32 into a configuration that mimics the periphery of the fabric panel 12. That is, the outer peripheral band 34 has two parallel long sides, 35, 37 and two parallel short sides 39, 41. Due to the bias of the shaped spring wire 32, the support mesh 30 is held open and taut. The support mesh 30 has a periphery defined by an outer peripheral band 34. The outer peripheral band 34 surrounds an open central area 33.

Figure 3:
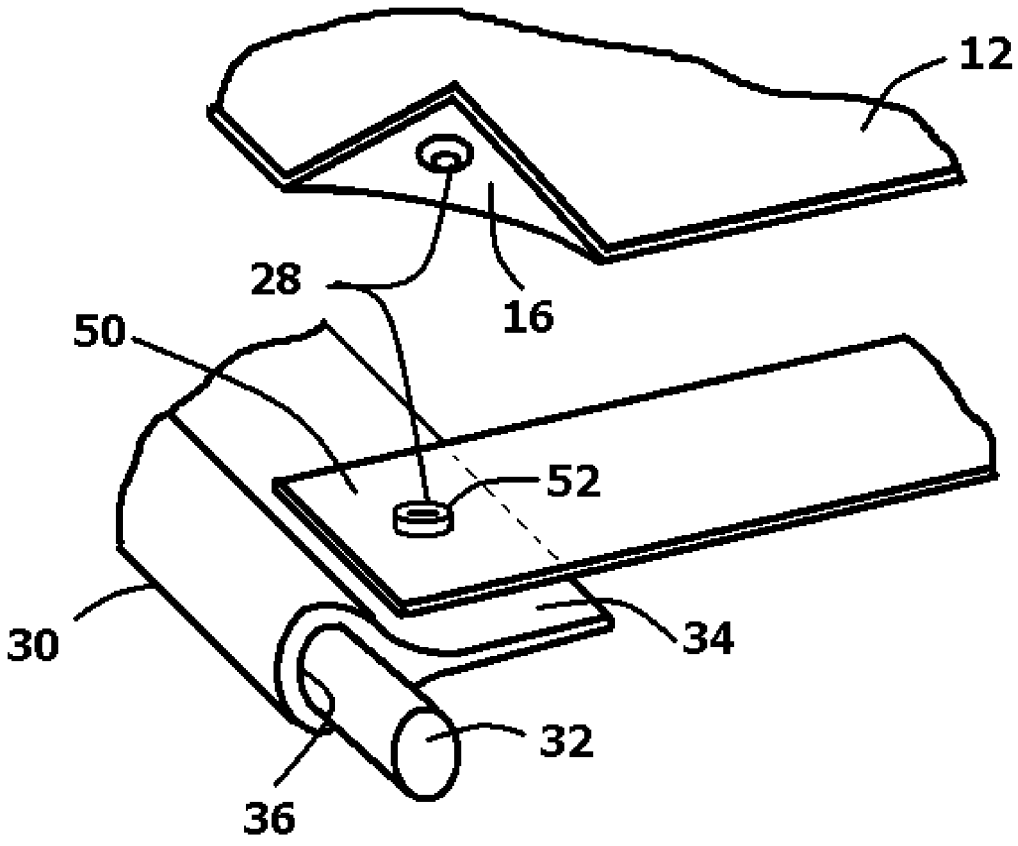
FIG. 3 is an enlarged fragment view of a section of the exemplary embodiment.

Referring to FIG. 3 in conjunction with FIG. 1 and FIG. 2, it can be seen that the outer peripheral band 34 is a folded sewn seam that forms a piping channel 36. The piping channel 36 runs the length of the outer peripheral band 34. The piping channel 36 is sized to accommodate the diameter of the shaped spring wire 32. The outer peripheral band 34 has the same general peripheral shape as does the fabric panel 12, albeit slightly smaller. Accordingly, the support mesh 30 with its outer peripheral band 34 is slightly smaller than the fabric panel 12. In this manner, the support mesh 30 is completely covered by the fabric panel 12 when the fabric panel 12 is affixed to the support mesh 30.

Since the outer peripheral band 34 holds the shaped spring wire 32 there is an opening in the outer peripheral band 34 to facilitate the introduction and removal of the shaped spring wire 32. In the shown embodiment, there is an open break 38 in the outer peripheral band 34. However, a slit in a continuous peripheral band can also be used. The outer peripheral band 34 by itself lacks the integrity to resist the spreading bias imparted by the shaped spring wire 32. The needed integrity is provided by using cross straps. The support mesh 30 utilizes a plurality of short cross straps 40 and a plurality of long cross straps 42. The short cross straps 40 extend in parallel across the open central area 33 between the long sides 35, 37 of the outer peripheral band 34. That is, each short cross straps 40 has a first end 44 that attaches to the first long side 35 of the outer peripheral band 34 and an opposite second end 46 that attaches to the second long side 37 of the outer peripheral band 34. Likewise, the support mesh 30 also has the plurality of long cross straps 42. The long cross straps 42 extend in parallel across the open central area 33 between the short sides 39, 41 of the support mesh 30. Each long cross strap 42 has a first end 48 that attaches to the first short side 39 of the outer peripheral band 34 and an opposite second end 49 that attaches to the second short side 41 of the outer peripheral band 34.

The long cross straps 42 and the short cross straps 40 are physically attached to the outer peripheral band 34. The long cross straps 42 and the short cross straps 40 are arranged in a crisscross pattern over the open central area 33. Like the mesh on a snow shoe, the crisscross pattern prevents the support mesh 30 from sinking into soft ground, such as sand. In this manner, the overall support mesh 30 supports the fabric panel 12 and enables the fabric panel 12 to resist being pressed into sand or other soft surfaces. The long cross straps 42 and the short cross straps 40 can be sewn to the outer peripheral band 34. This creates reinforced areas 50 where the outer peripheral band 34 and the cross straps 40, 42 overlap. If sewn, separate snap head rivets 52 are used in the reinforced areas 50. The snap head rivets 52 provide a preferred type of detachable fastener 28 in the reinforced areas 50 while supplementing the sewn connection in the reinforced areas 50. It will be understood that the snap head rivets 52 can be used without the addition of sewing, provided the snap head rivets 52 provide sufficient binding between the outer peripheral band 34 and the cross straps 40, 42.

Detachable fasteners 28 are present on the fabric panel 12 and the support mesh 30. In the illustrated embodiment, the detachable fasteners 28 are mechanical snap fasteners. Such detachable fasteners 28 do not easily foul when contacted with sand or dirt on the ground. Furthermore, such detachable fasteners 28 work equally well both when wet and when dry. However, other detachable fasteners, such as hook fasteners, button fasteners, and tie fasteners can be substituted for the illustrated snap fasteners.

Figure 4:
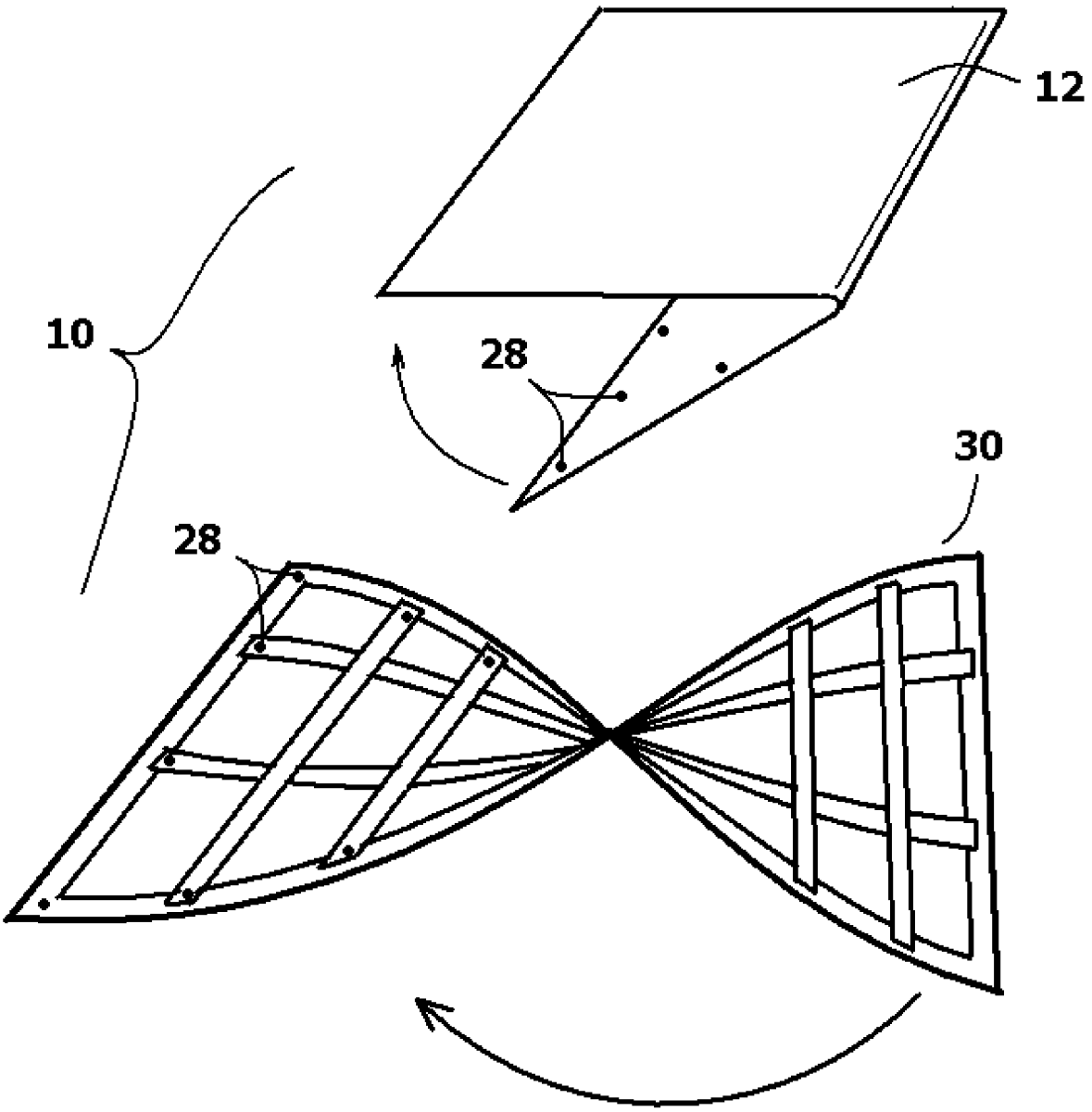
FIG. 4 shows the exemplary embodiment of the ground cover assembly folded for storage.

Referring to FIG. 4, in conjunction with FIG. 1, FIG. 2 and FIG. 3, it will be understood that the fabric panel 12 can be attached to the support mesh 30, such as in FIG. 1, or detached from the support mesh 30, such as in FIG. 4. In FIG. 4, the support mesh 30 is grabbed by the short sides 23, 24 and twisted. This causes the support mesh 30 to neatly fold, as is indicated in FIG. 4. The support mesh 30 remains in this folded configuration for as long as it is held or bound. Once released, the support mesh 30, under the spreading bias of the shaped spring wire 32, instantly pops open to the open flat configuration of FIG. 1 and FIG. 2. It will be understood that the fabric panel 12 can be attached to the support mesh 30 when the support mesh 30 is folded. As such, the fabric panel 12 pops open to its full taut shape as the support mesh 30 pops open.

Referring to all figures, when in use at a beach or similar location, the fabric panel 12 is attached to the support mesh 30 to complete the ground cover assembly 10. The ground cover assembly 10 can be folded for easy carrying. Once at a selected destination, the ground cover assembly 10 can be released. The ground cover assembly 10 instantly pops open, therein causing the fabric panel 12 to become fully open, flat and taut. The fabric panel 12 can then be sat or stood upon. The underlying support mesh 30 supports the fabric panel 12 and prevents the fabric panel 12 from deforming significantly into the sand or underlying ground.

If a person wants to use the fabric panel 12 for a secondary purpose, such as to dry after swimming, then the fabric panel 12 is detached from the support mesh 30. Once detached, the fabric panel 12 is just an ordinary towel, blanket, or the like. The fabric panel 12 can then be wrapped around a user's body or used to dry an object. After use, the fabric panel 12 can be reattached to the support mesh 30. Since the fabric panel 12 is held fully open by the support mesh 30, the fabric panel 12 dries quickly. The support mesh 30 is hydrophobic and does not absorb moisture from, or transfer moisture to, the fabric panel 12.

To launder the fabric panel 12, the fabric panel 12 is detached from the support mesh 30 and washed in the traditional manner of a towel or blanket. To launder the support mesh 30, the support mesh 30 can be shaken or sprayed with water from a hose.

Alternatively, the shaped spring wire 32 can be removed from the support mesh 30 and the support mesh 30 can be laundered in a traditional manner.

It will be understood that the embodiment of the present invention that is illustrated and described is merely exemplary and that a person skilled in the art can make many variations to that embodiment. For instance, the length and width of both the fabric panel and support mesh can be selectively altered as a matter of design choice. All such embodiments are intended to be included within the scope of the present invention as defined by the claims.

What is claimed is:

1. A ground cover assembly, comprising:

a support mesh having a peripheral band that surrounds an open central area;

cross straps that extend across said open central area between points along said peripheral band, wherein said cross straps overlap said peripheral band and form reinforced areas, and wherein said cross straps are joined to said peripheral band in said reinforced areas;

a spring wire engaging said peripheral band of said support mesh, wherein said spring wire biases said peripheral band into an open, flat configuration; a first plurality of fasteners disposed on said support mesh, wherein at least some of said first plurality of fasteners are disposed in said reinforced areas;

a fabric panel;

a second plurality of fasteners disposed on said fabric panel, wherein said second plurality of fasteners selectively interconnects with said first plurality of fasteners, therein connecting said fabric panel to said support mesh, wherein said fabric panel covers said open central area and wherein said fabric panel is supported in said open central area by said cross straps.

2. The assembly according to claim 1, wherein said peripheral band has two parallel long sides and two parallel short sides.

3. The assembly according to claim 2, wherein said cross straps include a first plurality of cross straps that extend in parallel across said open central area between said parallel long sides.

4. The assembly according to claim 3, wherein said cross straps include a second plurality of cross straps that extend in parallel across said open central area between said parallel short sides.

5. The assembly according to claim 1, wherein said peripheral band of said support mesh defines a channel for receiving said spring wire within said peripheral band.

6. The assembly according to claim 5, wherein said peripheral band has an open break that provides access to said channel, therein enabling said spring wire to be selectively removed from and inserted into said channel in said peripheral band.

7. A ground cover assembly, comprising:

a peripheral band that surrounds an open central area; cross straps that extend across said open central area between connection points along said peripheral band, wherein said cross straps extend onto said peripheral band to form reinforced areas where said cross straps and said peripheral band are joined together, and wherein said peripheral band and said cross straps form a support mesh;

a first plurality of fasteners disposed on said support mesh, wherein at least some of said first plurality of fasteners disposed on said support mesh are in said reinforced areas;

a fabric panel;

a second plurality of fasteners disposed on said fabric panel, wherein said second plurality of fasteners selectively interconnect with said first plurality of fasteners, therein connecting said fabric panel to said support mesh, wherein said fabric panel fully covers said support mesh and wherein said fabric panel is supported in said open central area by said cross straps;

further including a spring wire that engages said peripheral band of said support mesh, wherein said spring wire biases said peripheral band into an open, flat configuration.

8. The assembly according to claim 7, wherein said peripheral band has two parallel long sides and two parallel short sides.

9. The assembly according to claim 8, wherein said cross straps include a first plurality of cross straps that extend across said open central area between said parallel long sides.

10. The assembly according to claim 9, wherein said cross straps include a second plurality of cross straps that extend across said open central area between said parallel short sides.

11. The assembly according to claim 7, wherein said peripheral band of said support mesh defines a channel for receiving said spring wire within said peripheral band.

12. The assembly according to claim 11, wherein said peripheral band has an open break that provides access to said channel, therein enabling said spring wire to be selectively removed from and inserted into said channel in said peripheral band.

13. The assembly according to claim 7, wherein said support mesh is made from flexible hydrophobic fabric.

* * * * *